US006644061B1

(12) United States Patent
Woolfson

(10) Patent No.: US 6,644,061 B1
(45) Date of Patent: Nov. 11, 2003

(54) SOUND MUFFLING DEVICE FOR AN AIR CONDITIONING UNIT

(76) Inventor: Joseph W. Woolfson, 10 Montague Ter., Apt. 3A/3B, Brooklyn, NY (US) 11201

( * ) Notice: Subject to any disclaimer, the term of this patent is extended or adjusted under 35 U.S.C. 154(b) by 0 days.

(21) Appl. No.: 10/211,501

(22) Filed: Aug. 2, 2002

(51) Int. Cl.[7] ..... F25D 19/00; F25D 23/12
(52) U.S. Cl. ..... 62/296; 62/259.1; 62/262
(58) Field of Search ..... 62/296, 259.1, 62/262, 263; 181/198, 202; 454/906

(56) References Cited

U.S. PATENT DOCUMENTS

| | | | | |
|---|---|---|---|---|
| 2,901,989 A | | 9/1959 | Mondi | |
| 4,114,186 A | | 9/1978 | Dominguez | |
| 4,730,423 A | * | 3/1988 | Hughes | 62/259.1 |
| 4,991,406 A | | 2/1991 | Fujii et al. | |
| 5,159,789 A | | 11/1992 | Haapanen | |
| 5,341,860 A | | 8/1994 | Klein | |
| 5,386,702 A | | 2/1995 | Wiesen | |
| 5,655,382 A | | 8/1997 | Chen | |
| 5,657,582 A | | 8/1997 | Chitwood | |
| 5,979,172 A | | 11/1999 | Teller | |

FOREIGN PATENT DOCUMENTS

| | | |
|---|---|---|
| JP | 10-197041 | 7/1998 |

* cited by examiner

*Primary Examiner*—Chen Wen Jiang
(74) *Attorney, Agent, or Firm*—Cohen, Pontani, Lieberman & Pavane

(57) ABSTRACT

A device for muffing the sound of water droplets falling onto an upper surface of the housing of an air conditioning unit that extends beyond the side of a building is disclosed. The muffling device comprises a plurality of screens of different fineness of mesh, and a frame for holding the plurality of screens arranged in a progressively finer parallel spaced-apart relationship. The device is secured to the housing of the air conditioning unit with the finest mesh screen closest to and in parallel relation with the upper surface of the housing.

17 Claims, 5 Drawing Sheets

SOUND MUFFLING DEVICE FOR AN AIR CONDITIONING UNIT

BACKGROUND OF THE INVENTION

1. Field of the Invention

The present invention relates to a sound muffling device for an air conditioning unit. More specifically, the present invention is directed to a device for muffling the sound produced by rain or dripping water hitting the housing of an air conditioner.

2. Description of the Related Art

Air conditioning units are ubitiquously utilized for ventilating and cooling air in houses, apartments and other types of residences. In modern residences, air conditioning units typically include a central air conditioning system integrated within the residence. However, older residences, apartment buildings and office buildings without such an integrated central air conditioning system generally use one or more wall-mounted air conditioning units for cooling air inside the residence. The wall-mounted air conditioning unit includes a housing that fits within an opening through the wall or through a partially open window and extends beyond the side of the outside of the residence or building.

One problem associated with wall-mounted air conditioning units occurs when water droplets fall on the upper surface of the air conditioning unit housing. Although rainfall is the most common source of water droplets, in multistory buildings water droplets may also fall from the condensate produced by another air conditioning unit disposed above the air conditioning unit housing. The impact of these water droplets whether raindrops or drops of air conditioner condensate falling on the upper surface of the air conditioning unit housing creates a repetitive, irritating noise that can be heard from inside the building. This noise often is sufficiently irritating and disturbing to keep residents of the building awake.

Previous attempts have been made to muffle the sound of water during rainfall. U.S. Pat. No. 5,386,702 to Weisen discloses a synthetic sponge or other resilient material that is secured to the top of the air conditioner for absorbing the physical impact of rain and water droplets that would otherwise impinge on the air conditioner unit housing. However, such sponge or resilient material quickly loses its effectiveness. Once a sufficient amount of water is absorbed into the material.subsequent water droplets will bounce off the water or rain-soaked material to create noise.

U.S. Pat. No. 5,159,789 to Haapanen discloses a noise baffle for reducing noise in a rain gutter system. However, the noise baffle is limited to reducing noise associated with a stream of water previously collected in a main gutter and flowing in one or more downspout sections of the rain gutter system and is-thus inapplicable to air conditioning units. A need thus exists in the art for a device that improves the muffling of sound associated with wall-mounted air conditioning units.

SUMMARY OF THE INVENTION

The present invention is directed to a device for muffing the sound of water droplets falling onto an upper surface of the housing of an air conditioning unit that extends beyond the side of a building. The sound muffling device comprises a plurality of screens of different fineness of mesh, and a frame for holding the plurality of screens arranged in a progressively finer parallel spaced-apart relationship. The device is secured to the housing of the air conditioning unit with the finest mesh screen closest to and in parallel relation with the upper surface of the housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters delineate similar elements.

DETAILED DESCRIPTION OF THE CURRENTLY PREFERRED EMBODIMENTS

Figure 1:
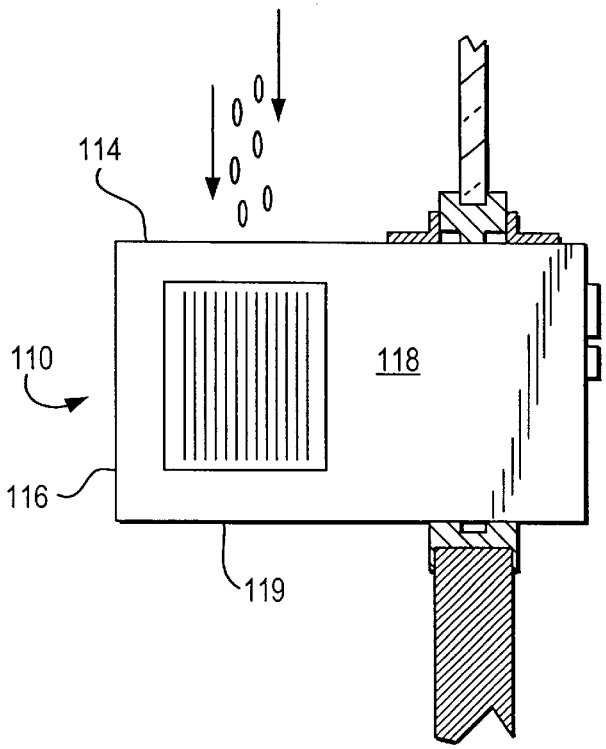
FIG. 1 (PRIOR ART)
FIG. 1 is a side view of a housing of an air conditioning unit extending through a window at the side of a building and water droplets falling thereon.

Referring now to FIG. 1 in detail, a housing 110 of a conventional air conditioning unit that extends through a window or a wall sleeve and beyond the side of a building is shown. As commonly installed a portion of the housing 110 is outside of the building with a portion of its upper surface 114, front 116, sides 118 and bottom 119 exposed to the elements. Housing 110 is typically made of plastic, metal, or any other weather-resistant material.

One particular problem occurs when water droplets from rainfall or condensation droplets from other air conditioning units disposed above housing 110 fall on the upper surface 114 of the housing 110. The impact of water droplets onto the upper surface 114 of the housing 110 typically causes a repetitive, irritating noise that may in turn cause residents to lose sleep.

Figure 2:
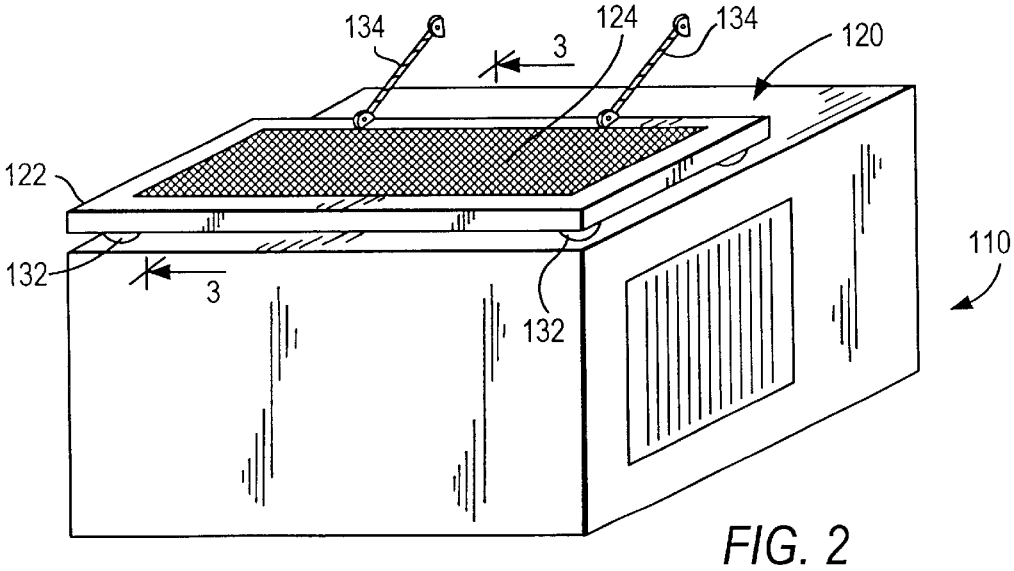
FIG. 2 is a perspective view of the air conditioning unit housing with a sound muffling device of the present invention.

Turning now to FIG. 2, the sound muffling device 120 of the present invention is mounted above the outside portion of the air conditioning unit housing 110. In accordance with the present invention, device 120 progressively breaks down the size of water droplets to muffle or reduce the sound associated with such droplets impacting the housing 110. Sound muffling device 120 is preferably secured in close parallel spaced-apart relation to the upper surface 114, for example between about one-quarter inch and two inches, preferably one-quarter inch, to enhance the efficiency of the noise muffling function. Blocks and/or wedges 132 are preferably utilized to create separation between sound muffling device 120 and air conditioning unit housing 110.

Muffling device 120 preferably includes a rectangular frame 122 and at least two screens of different fineness of mesh arranged in a progressively finer spaced-apart parallel relationship (FIG. 2). Each screen is capable of breaking down water droplets of progressively smaller diameters to thereby muffle the sound that would otherwise occur when heavy or large water droplets hit air conditioning unit housing 110.

Figure 3:
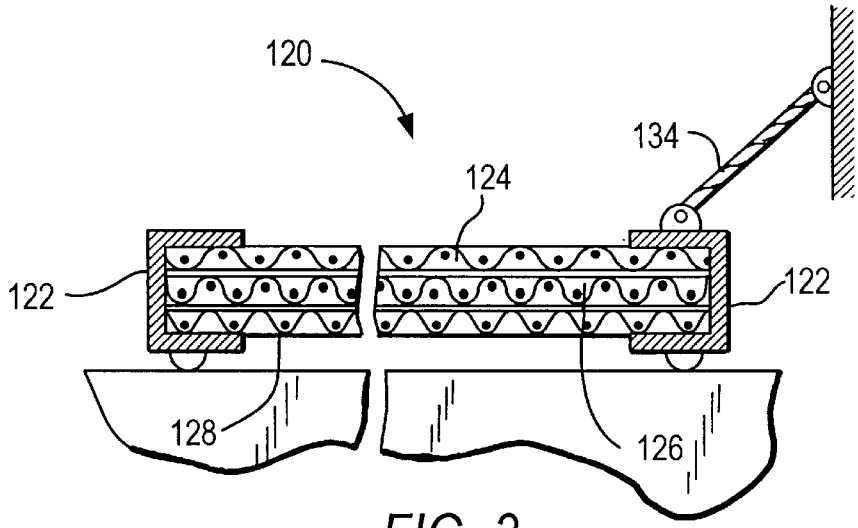
FIG. 3 is a cross section of the sound muffling device in FIG. 2 taken along the line 3—3.

In a preferred embodiment of the present invention and as shown in FIG. 3, sound muffling device 120 comprises three closely spaced apart screens of increasingly finer mesh, namely, a first screen 124 with a coarsest mesh furthest from housing 110, a second screen 126 with an intermediate mesh in an intermediate position and a third screen 128 with the finest mesh closest to the housing 110. By way of example and not limitation, the three screens can be of ten wires per inch, seven wires per inch and four wires per inch. Each of these screens is preferably made of plastic, fine metal wire, nylon netting, or some other durable material that is commonly used in screens.

Although three screens are illustratively depicted and presently preferred, sound muffling device 120 may include any plurality of screens to progressively reduce the size of water droplets and thereby muffle or reduce the sound associated with the impact of large water droplets against housing 110. In another embodiment of the present invention, the plurality of screens need not have increasingly finer mesh to progressively reduce the size of water droplets. For example, two or more closely spaced apart screens may have the same mesh size although the screen patterns are preferably not aligned.

Referring back to FIG. 2, one or more safety tethers 134 may be used to secure sound muffling device 120 to the side of a building. For example, safety tethers 134 can secure frame 122 to the side 118 of the building (as shown) or within the building through the window from which housing 110 extends from. Safety tethers 134 preferably comprise a strap or a rope of synthetic fiber such as, for example, nylon and/or other forms of durable and flexible material, although rigid rod or strap-like tethers may also be employed.

Figure 4:
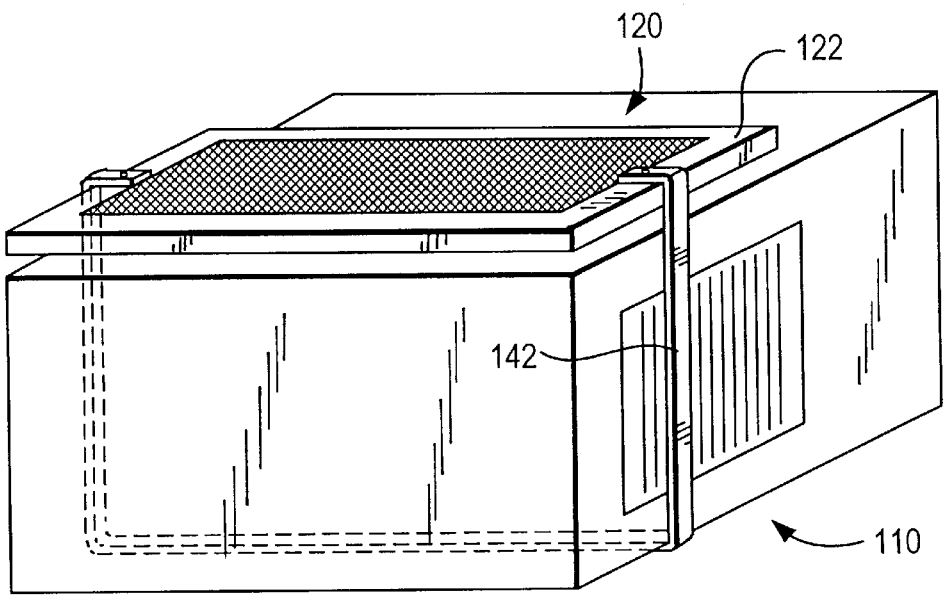
FIG. 4 is a perspective view of an air conditioning unit with belts for securing the sound muffling device to the air conditioner unit housing.

Numerous means for securing sound muffling device 120 to air conditioning unit housing 110 are also available. For example, FIG. 4 depicts the use of a belt 142 to secure sound muffling device 120 to air conditioning unit housing 110. Belt 142 extends around housing 110 along the bottom 119 and sides 118 of housing 110 and is secured to the frame 122 of muffling device 120. Belt 142 is preferably made of flaccid synthetic material, for example nylon, to extend around housing 110 and muffling device 120 to secure the muffling device to housing 110 although a more or less rigid strap may also be employed.

Figure 5:
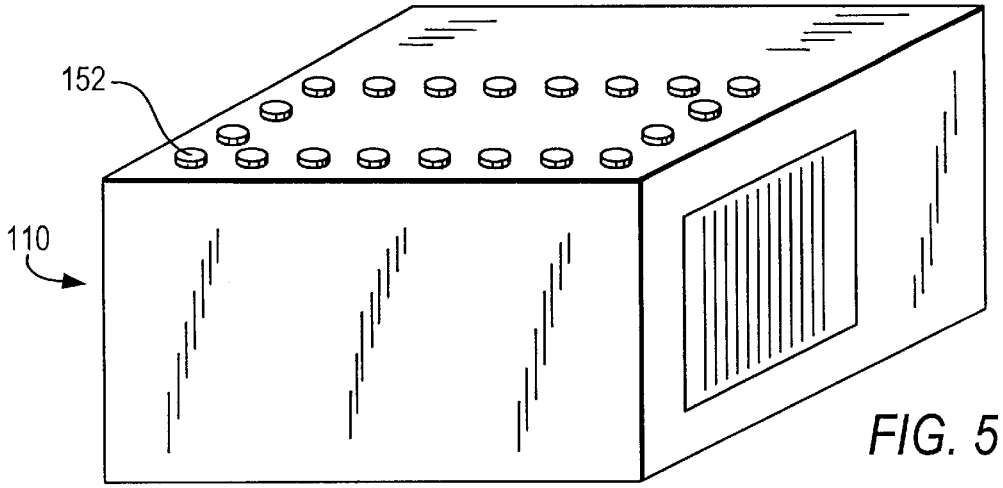
FIG. 5 is a perspective view of the air conditioning unit housing with a plurality of magnets secured to the upper surface of the housing for holding the sound muffling device on said housing.
Figure 6:
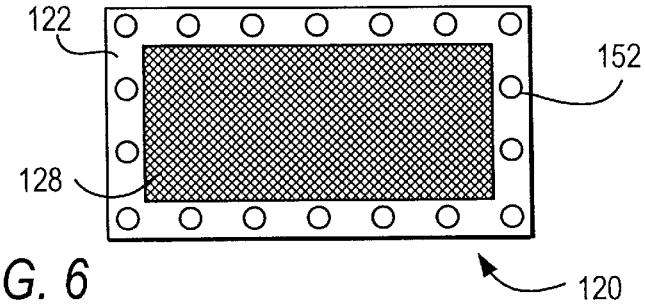
FIG. 6 is a bottom plan view of the sound muffling device of the present invention with magnets secured to the bottom surface of the frame of the device for holding the sound muffling device on said housing.
Figure 7:
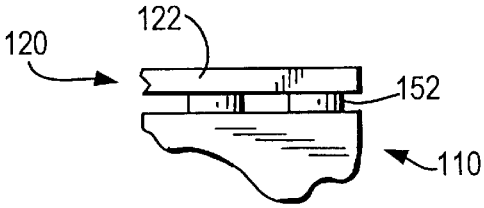
FIG. 7 is a side view of magnets secured between the sound muffling device and the air conditioning unit housing.

Another means for connecting the device 120 to the air conditioning unit housing 110 is shown in FIGS. 5 and 6. Magnets 152 are secured to either housing 110 (FIG. 5) or frame 122 (FIG. 6) of sound muffling device 120 to magnetically secure device 120 to housing 110 (FIG. 7). The magnets 152 may be any type of permanent magnet such as those made of iron, alnico or any other kind of permanent magnetic material. To operate effectively, if the magnets 152 are secured to housing 110, the frame 122 is preferably made of ferromagnetic material, and if the magnets are secured to the frame, the housing 110 should be ferromagnetic.

Figure 8:
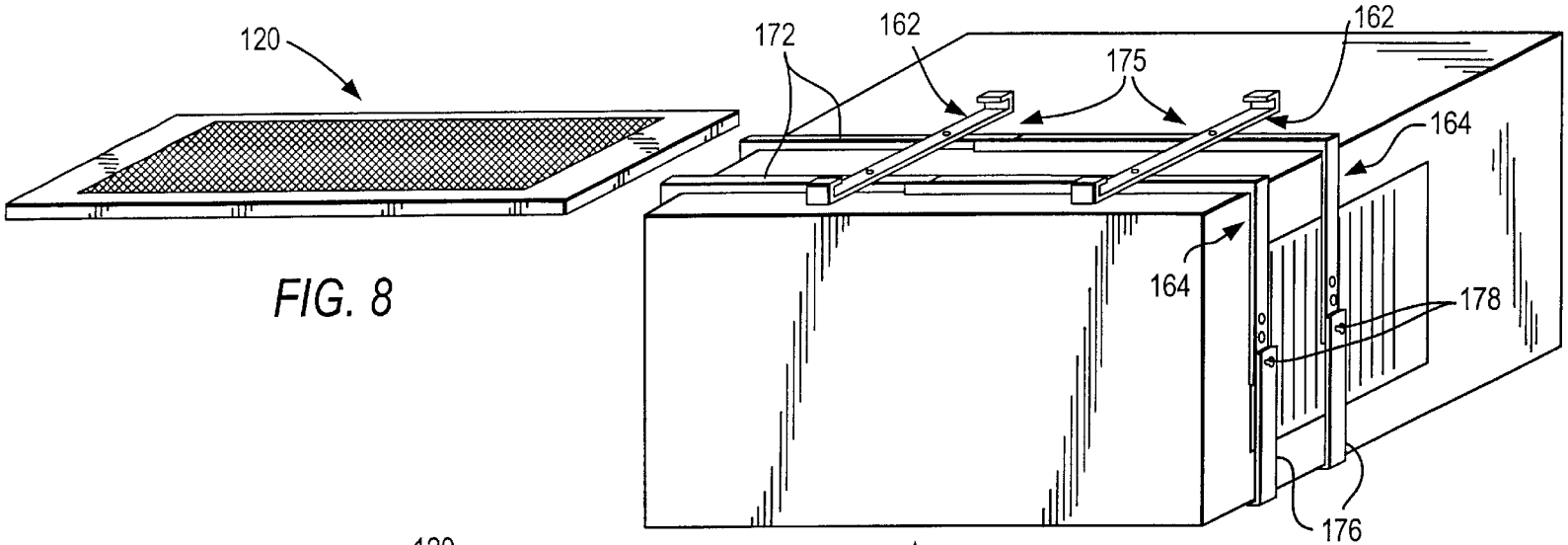
FIG. 8 is a perspective view of an air conditioning unit housing equipped with a means for slidably receiving and holding the muffling device on said housing.

FIG. 8 depicts another means of connecting sound muffling device 120 to air conditioning unit housing 110. Bars 162 are preferably configured to form a slot 175 for slidably receiving sound muffling device 120 from either side 118 of housing 110. Slot 175 may be fixed in width to receive a muffling device 120 of a particular size or may be adjustable to receive sound muffling devices 120 of different widths.

Figure 9:
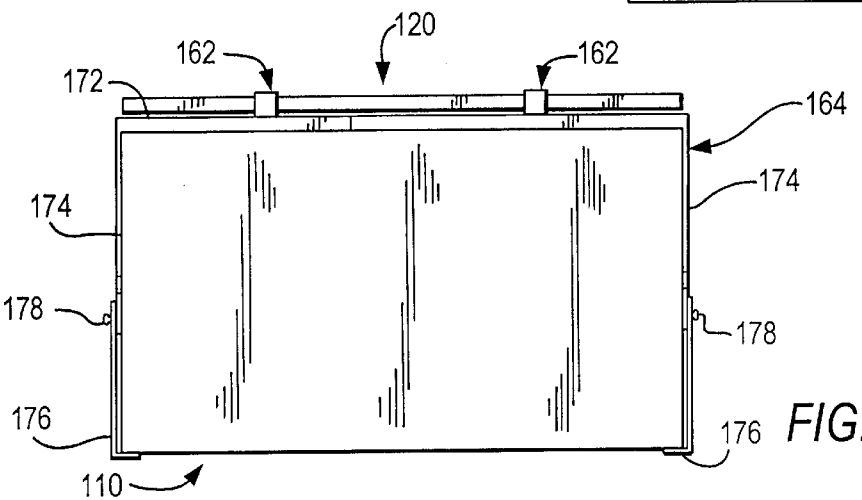
FIG. 9 is a side elevational view of the air conditioner housing of FIG. 8 with the sound muffling device held in place above the housing.

Bars 162 are secured to air conditioning unit housing 110 with at least one attaching assembly 164. In one embodiment of the present invention as shown in FIG. 8, each attaching assembly 164 is orthogonally aligned with respect to receiving bars 162 on the upper surface 114 of housing 110. Different forms of attaching assembly 164 are available. One form of attaching assembly 164 (FIG. 9) comprises a support bar 172 and retaining legs 176 that are securable to the support bar 172. Support bar 172 may be fixed in length or may be adjustable to attach onto housings 110 of different lengths. Each end of support bar 172 has an extending portion 174 that extends over the upper surface 114 and onto the sides 118 of housing 110.

A pair of retaining legs 176 secure support bar 172 to housing 110. Each retaining leg 176 extends at one end along the side 118 and over to the bottom 119 of housing 110 and is securable at the other end to the extending portion 174 of supporting bar 172. Retaining legs 176 are preferably slidable along the extending portion 174 to allow attaching assembly 164 to secure itself to different sizes of housing 110. Fasteners 178 or other form of securing means secure retaining legs 176 to the support bar 172 and thus secure attaching assembly 164 to housing 110.

Figure 10:
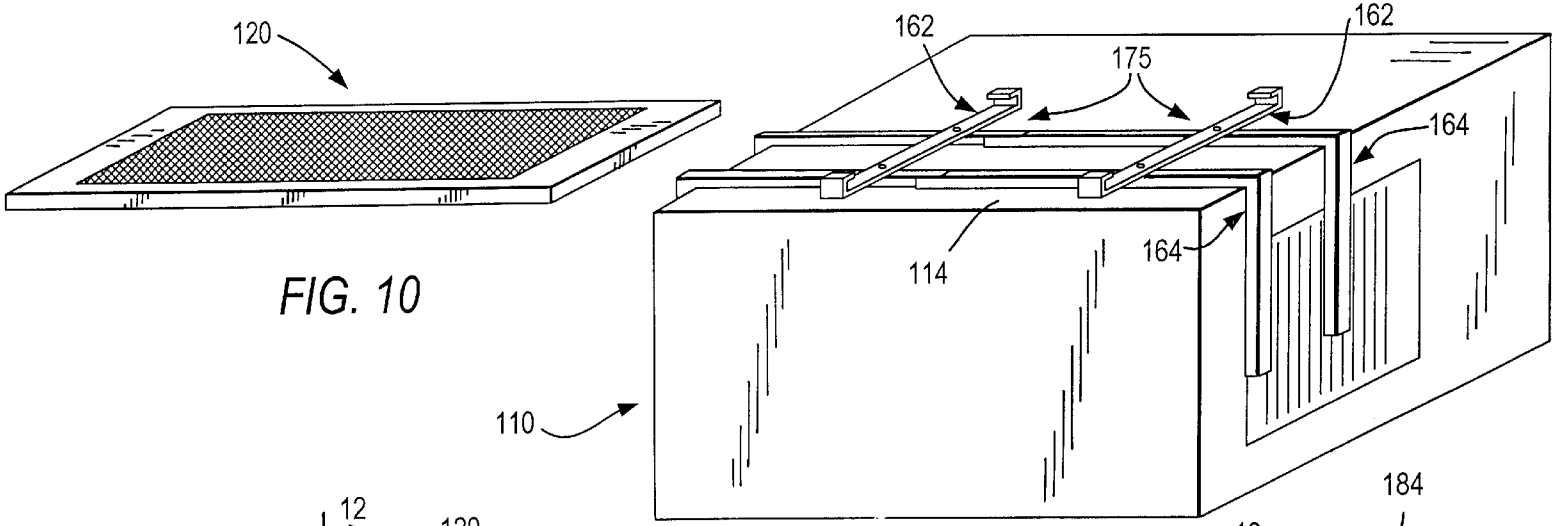
FIG. 10 is a perspective view of an air conditioning unit housing with another means for slidably receiving and holding the muffing device.
Figure 12:
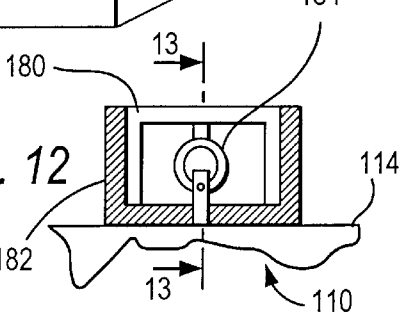
FIG. 12 is a cross-section of the support legs in the securing means of FIG. 11 taken along the line 12—12, said support legs being adjustable in length.
Figure 13:
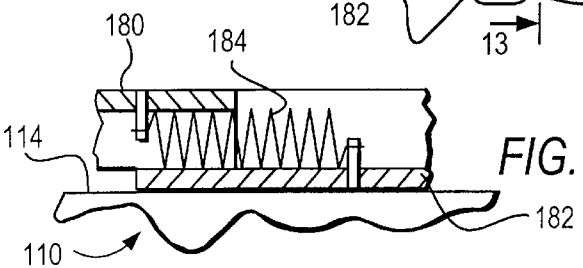
FIG. 13 is a cross-section of the in FIG. 12 taken along the line 13—13.
Figure 11:
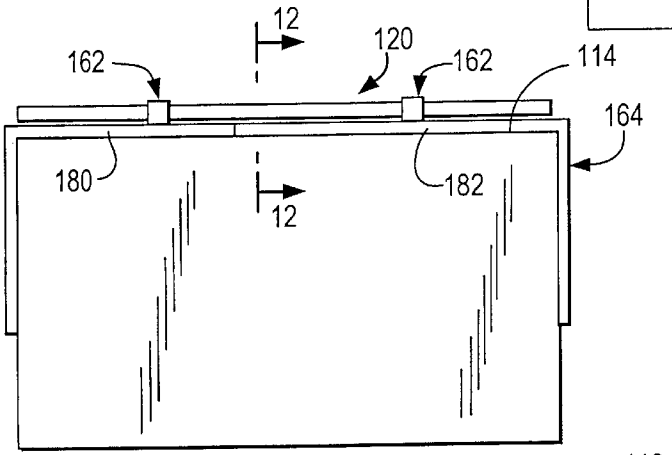
FIG. 11 is a side elevational view of the air conditioner housing with another means to secure the sound muffling device above the housing.

Another form of attaching assembly 164 (FIGS. 10 and 11) comprises a pair of support legs 180, 182 and a tension spring 184. One support leg 180 is slidably receivable into the other support leg 182 to allow attaching assembly 164 to secure itself to different sizes of housing 110. Tension spring 184 is preferably disposed within support leg 182 and secured to both support legs 180, 182 (FIGS. 12 and 13) so as to secure the both support legs together on the upper surface 114 of housing 110.

Accordingly, while there has been shown and described and pointed out various features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for muffling the sound of water droplets falling onto an upper surface of the housing of an air conditioning unit that extends beyond the side of a building, the muffling device comprising:

a plurality of screens of different fineness of mesh;

a frame for holding said plurality of screens arranged in a progressively finer spaced-apart parallel relationship with the finest mesh screen at one side of said frame; and means for securing said device to said housing of said air conditioning unit with the finest mesh screen closest to and in spaced parallel relation with the upper surface of said housing of said air conditioning unit.

2. The device of claim 1, wherein the finest mesh screen and the upper surface of said housing of said air conditioning unit are separated by about between one-quarter inch and two inches.

3. The device of claim 1, wherein the finest mesh screen and the upper surface of said housing of said air conditioning unit are separated by about one-quarter inch.

4. The device of claim 1, wherein said plurality of screens comprise at least one of plastic, fine metal wire and nylon netting.

5. The device of claim 1, wherein said securing means comprises at least one belt of sufficient length to extend around said housing of said air conditioning unit and around said frame to thereby secure said muffling device to said air conditioning unit.

6. The device of claim 1, wherein a plurality of magnets are secured to one of said frame and the upper surface of said housing of said air conditioning unit and disposed therein for magnetically holding said frame to said housing.

7. The device of claim 6, wherein said plurality of magnets comprise one of alnico and iron.

8. The device of claim 1, wherein said securing means comprises:

means for receiving said frame in close spaced parallel relation with the upper surface of said housing; and means for attaching said receiving means to said housing of said air conditioning unit.

9. The device of claim 8, wherein said attaching means extends around the sides of and over to the bottom of said housing of said air conditioning unit.

10. The device of claim 1, further comprising a safety tether secured to said frame and securable to the building for securing said muffling device to the building.

11. A device for muffling the sound of water droplets falling onto an upper surface of the housing of an air conditioning unit that extends beyond the side of a building, the muffling device comprising:

a plurality of screens;

a frame for holding said plurality of screens; and means for securing said device in spaced parallel relation with the upper surface of said housing of said air conditioning unit.

12. A device for muffling the sound of water droplets falling onto an upper surface of the housing of an air conditioning unit that extends beyond the side of a building, the device comprising:

a first screen having a coarse mesh capable of breaking down the water droplets to at most a first predetermined diameter and permitting the broken down water droplets to pass through said first screen;

a second screen disposed in a spaced-apart parallel relationship with said first screen and having an intermediate mesh capable of breaking down water droplets to at most a second predetermined diameter smaller than the first predetermined diameter passing through said first screen and permitting the broken down water droplets to pass through said second screen;

a third screen disposed in a spaced-apart parallel relationship with said second screen and having a fine mesh capable of breaking down water droplets to at most a third predetermined diameter smaller than the second predetermined diameter passing through said second screen and permitting the broken down water droplets to pass through said third screen;

a frame for holding said first, second and third screens in that order; and means for securing said device to said air conditioning unit with said third screen closest to and in closely spaced parallel relation with the upper surface of said air conditioning unit housing.

13. The device of claim 12, wherein said third screen and the upper surface of said housing of said air conditioning unit are separated by between about one-quarter inch and two inches.

14. The device of claim 12, wherein each of said first, second and third screens comprise one of plastic, fine metal wire and nylon netting.

15. The device of claim 12, wherein said securing means comprises at least one belt secured to said frame of sufficient length to extend around said housing of said air conditioning unit to thereby secure said muffling device to said air conditioning unit.

16. The device of claim 12, wherein said frame and said air conditioner housing comprises a plurality of magnets disposed between said frame and the upper surface of said housing of said air conditioning unit.

17. An apparatus comprising:

an air conditioning unit having a housing capable of being placed through a window of a building and extending beyond a side of the building;

a plurality of screens of different fineness of mesh for muffling the sound of water falling onto an upper surface of said housing of said air conditioning unit;

a frame for holding said plurality of screens arranged in a spaced-apart parallel relationship and progressively according to their relative fineness with the finest mesh screen at one side of said frame; and a means for securing said frame to said housing of said air conditioning unit with the finest mesh screen closest to and in spaced parallel relation with the upper surface of said housing of said air conditioning unit.

* * * * *